United States Patent [19]

Clark

[11] 3,939,586

[45] *Feb. 24, 1976

[54] RELATIVELY MOVABLE BODIES AND METHODS OF MAKING THEM

[76] Inventor: Charles F. Clark, 99 Avondale Road, Yonkers, N.Y. 10710

[ * ] Notice: The portion of the term of this patent subsequent to Sept. 13, 1988, has been disclaimed.

[22] Filed: Nov. 12, 1973

[21] Appl. No.: 414,759

Related U.S. Application Data

[63] Continuation of Ser. No. 150,538, June 7, 1971, Pat. No. 3,820,263, which is a continuation-in-part of Ser. No. 795,305, Jan. 30, 1969, Pat. No. 3,604,134.

[52] U.S. Cl. ..... 40/70 R; 35/74

[51] Int. Cl.[2] ..... G09F 11/04

[58] Field of Search ..... 40/70 R, 113; 35/74; 235/78

[56] References Cited

UNITED STATES PATENTS

| | | | |
|---|---|---|---|
| 601,949 | 4/1898 | Cowen | 40/113 |
| 784,974 | 3/1905 | Biggs | 40/113 |
| 857,662 | 6/1907 | Odor | 40/70 R |
| 2,029,209 | 1/1936 | Zak | 40/70 R |
| 2,386,082 | 10/1945 | Attridge | 40/70 R X |
| 2,932,104 | 4/1960 | Corbett | 40/113 |
| 3,003,269 | 1/1961 | Cobb | 40/70 R |
| 3,321,858 | 5/1967 | Bailey | 40/70 R |
| 3,471,956 | 10/1969 | Walters | 40/70 R |
| 3,604,134 | 9/1971 | Clark | 40/70 R |
| 3,820,263 | 6/1974 | Clark | 40/70 R |

FOREIGN PATENTS OR APPLICATIONS

| | | | |
|---|---|---|---|
| 1,055,405 | 1/1967 | United Kingdom | 40/70 R |

*Primary Examiner*—John H. Wolff

*Attorney, Agent, or Firm*—Amster & Rothstein

[57] ABSTRACT

A dial suitable for calculations, demonstrations, teaching and amusements is composed of a front disc, a rear disc and an inner disc rotatable relatively to the other two discs and having indicia visible through a window provided in the front disc and possibly the rear disc. According to the method of the present invention the rotation of the inner disc is made possible by cutting a central circle in the inner disc which, however, is connected to it by thin tabs, gluing the central circle to the front and rear discs and then breaking all the tabs by turning the inner disc. According to another feature, all three discs are initially cut from a single sheet and joined by strips which are folded when the discs are assembled. The fold connected to the rear disc may be extended to form a sheet which may be conveniently glued or stapled inside or outside a magazine or book to form an integral part of the publication. According to a further embodiment two such dials may be joined by a folded sheet portion.

7 Claims, 7 Drawing Figures

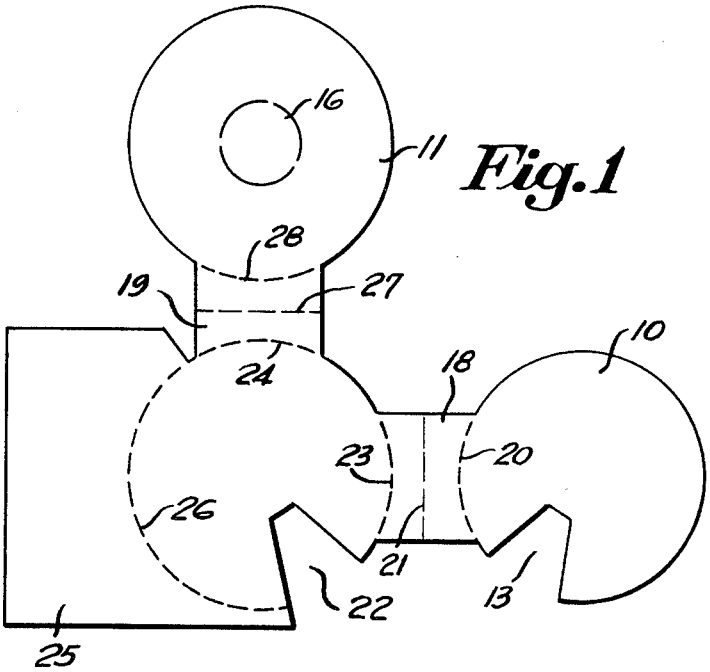
Fig.1
Fig.4
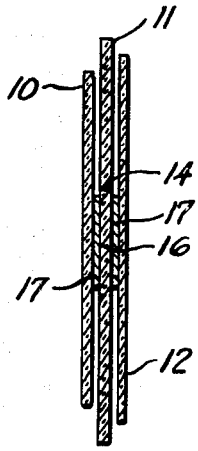
Fig.2
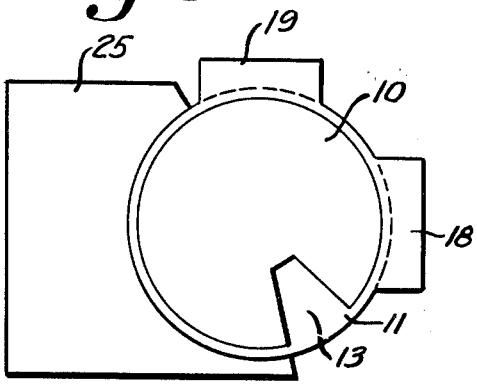
Fig.3
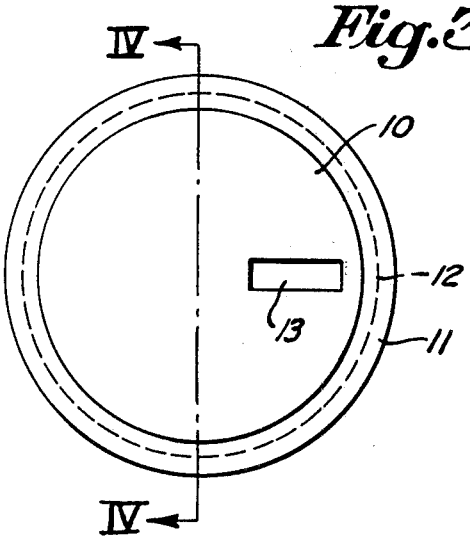

RELATIVELY MOVABLE BODIES AND METHODS OF MAKING THEM

This is a continuation, of application Ser. No. 150,538 filed June 7, 1971, now U.S. Pat. No. 3,820,263 which was, in turn, a continuation in part of application Ser. No. 795,305 filed Jan. 30, 1969 which latter application is now U.S. Pat. No. 3,604,134.

DESCRIPTION OF THE INVENTION:

This invention relates to dials and methods of making them.

Dials now in general use consist as a rule of three superposed discs with the inner disc being rotatable relatively to the outer and inner discs. The outer disc usually contains several windows, while the inner disc has inscriptions, drawings, numerals and the like which can be made visible through the windows by turning the inner disc. The inner disc is often made larger than the outer disc and its outer edges may carry indicia corresponding to indications upon the outer disc.

Practical experience has shown that the manufacture of such dials, particularly on a large scale, presents various problems. While, obviously, pins or pivots can be used to provide the rotation of the inner disc, their application is time consuming. Furthermore, in many instances it is desired that the dials should have flat outer and inner surfaces. This is particularly important when dials are to be used in books, magazines or other publications. In recent years authors and publishers of various books and magazines wanted to use dials as illustrations of the subject matter of a book or as an advertisement. Such dials, however, must be completely flat so as not to damage adjacent pages or covers.

An object of the present invention is to improve existing dials and methods of making them.

Other objects will become apparent in the course of the following specification.

In the accomplishment of the objectives of the present invention it was found desirable to cut, stamp or otherwise make a dial from a single sheet by providing two circular shapes which will later form the outer and rear discs and which are joined by strips at right angles to each other to a circular shape which will be the inner disc. The last mentioned circular shape can have an angular extension located in line with the future outer disc and suitable for attachment to the binding of a book or magazine. A round slot of suitable size is cut in the center of the inner disc. To prevent this center piece from falling off the round slot is interrupted by tabs which join the central piece to the rest of the inner disc. After the strips have been folded so that the discs are superposed, both surfaces of the central piece are coated with a suitable glue and then the discs are pressed together. Thereafter a slight turning of the inner disc will suffice to tear the tabs, so that the inner disc will be rotatable between the outer and rear discs. Obviously before the discs are assembled they will be provided with the desired printing and the outer disc and possibly the rear disc will be provided with windows through which parts of the printing upon the inner disc will be visible.

In some instances it may be desirable to have two dials located one next to the other or separated by some printed sheets of a publication. In that case it is advisable to cut the two dials out of two sheets and then join their angular extensions by glue or other suitable means. Obviously the joining should be carried out in such manner that after folding the circular shapes will be located one on top of the other.

The invention will appear more clearly from the following detailed description when taken in connection with the accompanying drawing showing by way of example only, preferred embodiments of the inventive idea.

In the drawing:

FIG. 1 is a plan view showing a cut sheet provided with circular shapes to be used as discs.

FIG. 2 is a plan view showing the assembled dial.

FIG. 3 is a plan view showing a somewhat different dial.

FIG. 4 is a section along the line IV—IV of FIG. 3.

FIG. 1 shows the outlines of a dial which have been cut, stamped or shaped in any other way from a sheet of thin cardboard, a plastic sheet or any other suitable material. Before or after the cutting the sheet is provided with the desired printing, inscriptions or the like (not shown).

Figure 5:
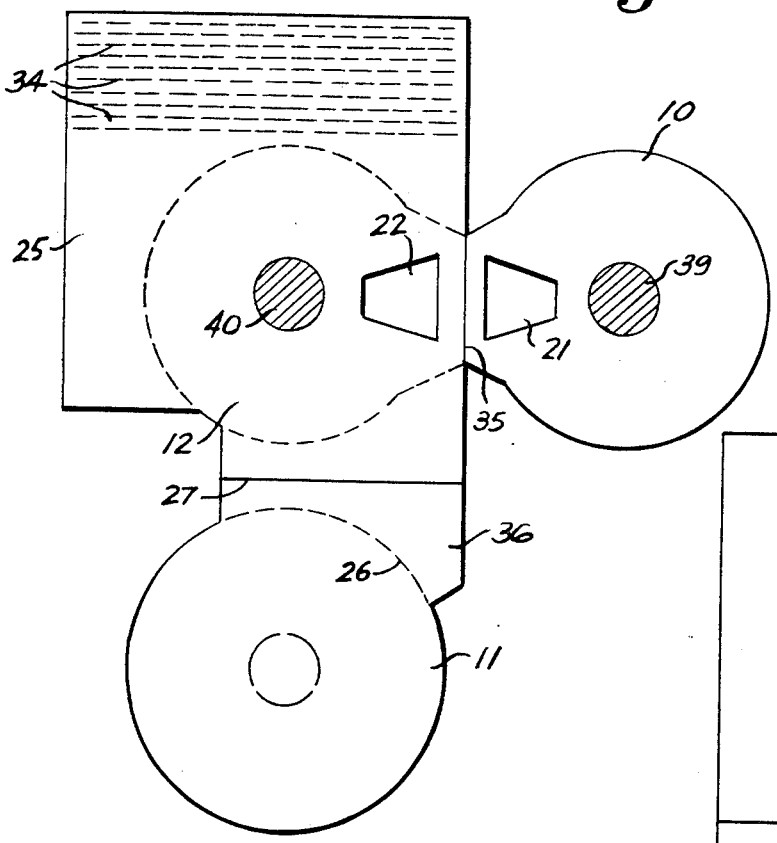
FIG. 5 is a plan view showing an alternate embodiment of the invention, unassembled.
Figure 7:
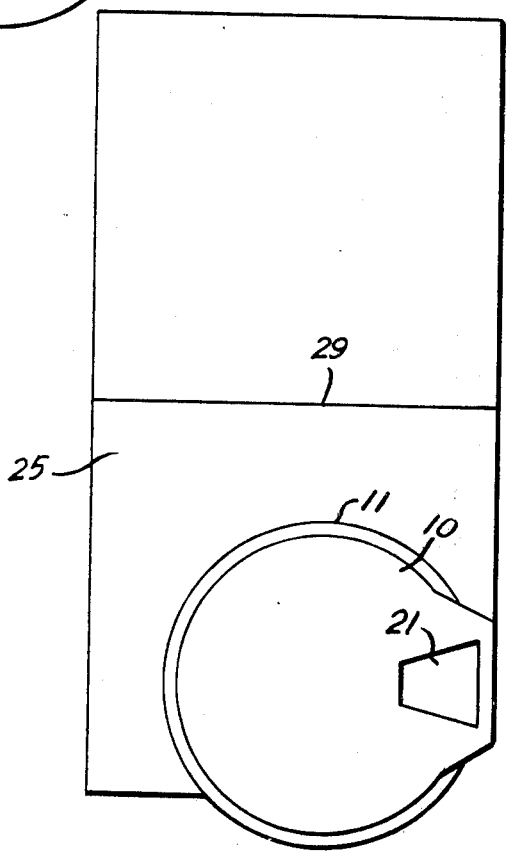
FIG. 7 is a plan view of a further alternate embodiment of the present invention.
Figure 6:
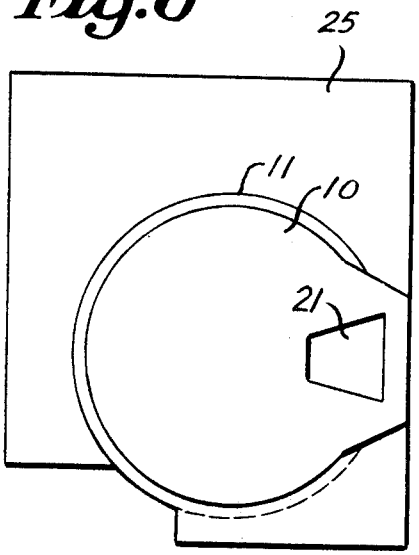
FIG. 6 is a plan view of the alternate embodiment of FIG. 5, assembled.

The cut out sheet includes an outer disc 10, an inner disc 11 and a rear disc 12. A narrow strip 18 joins the outer disc 10 with the rear disc 12 and a narrow strip 19 joins the rear disc 12 with the inner disc 11. When the discs were cut the circumferential portion 20 of the disc 10 facing the strip 18 was cut by small slits interrupted by tabs extending between the slits. Thus while the disc 10 is still of one piece with the strip 18 it can be easily separated from the strip for reasons which will be explained in detail hereinafter.

The strip 18 has a fold 21 located substantially in the middle of the strip and also consisting of small slits interrupted by tabs.

The discs 10 and 12 are provided with suitable windows 13 and 22, respectively, through which printing upon the inner disc 11 may be examined. In the example illustrated the windows 13 and 22 overlap each other when the dial is folded in the manner shown in FIG. 2. Obviously the windows may be differently located and their shape and arrangement may be varied depending upon individual requirements.

The disc 12 has a circumferential portion 23 facing the strip 18 which is also cut by slits interrupted by tabs. The circumferential portion 24 of the disc 12 facing the strip 19 is also cut by slits interrupted by tabs.

The illustrated construction includes a large rectangular piece 25 connected with the disc 12 by a circumferential disc portion 26 also consisting of slits interrupted by tabs.

The strip 19 is provided with an intermediate fold 27 consisting of slits interrupted by tabs.

In the example illustrated the inner disc 11 has a somewhat larger diameter than the discs 10 and 12, so that when the dial is folded (FIG. 2) the disc 11 can be conveniently rotated.

The disc 11 has a circumferential portion 28 joining the strip 19 and consisting of slits interrupted by tabs. Furthermore, the disc 11 has a central round portion 16 separated from the rest of the disc by slits and tabs.

When the sheet shown in FIG. 1 is being assembled, the operator will first bend lightly the inner disc 11 along the fold 27 over the disc 12 and then the disc 10 will be lightly bent over the disc 11. Both surfaces of the central portion 16 are coated with layers of any suitable glue. The coating is facilitated by the fact that the limits of the central portion 16 are clearly visible due to the provision of the slits. Then the three discs 10, 11 and 12 are firmly pressed together until the glue solidifies and firmly connects the central portion 16 with the adjacent inner surfaces of the discs 10 and 12.

In many instances it may be found more convenient to apply the glue to both surfaces of the portion 16 before the discs are bent one over the other, and/or to apply the glue to the corresponding inner central portions of the discs 10 and 12.

The folded dial is shown in FIG. 2. The user turns lightly the inner disc 11 and then the tabs joining the central portion 16 with the rest of the disc 11 will break off and the disc 11 will easily rotate around the central piece 16 which will be firmly glued to the discs 10 and 12.

The dial is then ready for use.

At the present time on many occasions dials of the described type are used as inserts in weekly or monthly magazines or even books. These dials may consist of advertisements carried by a magazine. In text books they may constitute means presenting a certain subject, certain formulae or calculations to the pupils. On other occasions they may simply constitute media presenting interesting or amusing information in compound form.

In the illustrated embodiment the piece, strip or sheet 25 serves to attach the dial to the back of a book or magazine. The piece 25 may be easily fixed to the back along will all the other pages of the book or magazine; it may be of such length that the dial will be located in the middle of the page area. The strips 18 and 19 will facilitate location of the dial for a user who is going over the pages of the book.

Assembly of a book or magazine often makes it necessary to place the strip 25 across the fold of the pages. To facilitate this the strip 25 is provided with a fold 29 which can be placed over the fold of the pages.

In some cases the book or magazine requires two dials. Then the two dials can be made separately and then joined to each other by bending a portion of the strip 25 located between its outer edge and the fold 29 and gluing the portion to the strip 25 of the second dial. The two interconnected dials which are thus formed can be used as a separate piece or can be a part of a magazine or book. The binding can be so arranged that the two dials are located next to each other or are separated by intervening pages.

Instead of locating two dials one over the other it is also possible to place several dials one next to the other. In that case the strip 25 will be eliminated while the fold 29 could be used to join the dials to a transverse holding piece (not shown).

Another possibility is to attach the rear discs of several dials to a single supporting sheet.

In a different construction, the front discs of several dials located side by side could be replaced by a single sheet glued to the central circles of the inner sheets and provided with windows through which inscriptions upon the inner sheets would be visible.

Obviously, the dial may be made as an independent separate article without the strips 18, 19 or 25. Such dial is illustrated in FIGS. 3 and 4, similar parts having been provided with the same numerals.

The dial of FIGS. 3 and 4 is preferably made by cutting out separately the three discs 10, 11 and 12, providing the inner disc 11 with a partly cut central portion 16, applying layers of glue 17 to opposite surfaces of the central portion and then pressing the three discs together until the glue solidifies and firmly connects the central portion 16 with the adjacent surfaces of the discs 10 and 12.

The dial of FIGS. 3 and 4 has a window 13 of a somewhat different shape than that shown in FIGS. 1 and 2. Furthermore, the rear disc 12 is shown as being somewhat larger than the front disc 10, although of course, the inner disc 11 must be larger than both discs 10 and 12. Otherwise the construction and operation of both dials essentially the same.

If desired, the central portions of the outer and rear discs 10 and 12 corresponding to the central portion 16 may be somewhat depressed, so that the outer portions of these discs will be more outstanding. This construction (not shown) has the advantage that the inner disc 11 will be somewhat spaced from the discs 10 and 12 and can be conveniently rotated without any friction.

In some instances the rear disc 12 can be replaced by a small cover or it can be eliminated entirely, so that the dial will consist only of the front disc 10 and the inner disc 11. However, such construction was found to be not as effective as the one consisting of three discs.

The glue used for joining the central portion of the inner disc may be replaced by heat sealing or other suitable means.

Other changes may be made in the illustrated constructions within the scope of the appended claims.

I claim:

1. The method of making a device having relatively movable parts, said method comprising: providing at least first and second sheets, forming at least one perforation within said first sheet thereby defining a substantially completely enclosed formed section having at least one discontinuity within the periphery thereof, superposing said first and second sheets so that said formed section in said first sheet overlies said second sheet, adhering one side of said formed section to one side of said second sheet, whereby manipulation of said first and second sheets relative to one another shears said discontinuity thereby separating said formed section from said first sheet, said forming of said perforation including defining said formed section so that said first sheet is capable of movement relative to said formed section fixed to said second sheet.

2. The method according to claim 1, including providing a third sheet, superposing said first, second and third sheets so that said formed section in said first sheet confronts adjacent facing sides of said second and third sheets, adhering both sides of said formed section to said second and third sheets respectively thereby fastening said second and third sheets to opposite sides of said formed section, whereby manipulation of said first sheet relative to said second and third sheets shears said discontinuity thereby freeing said formed section from said first sheet, retaining said second and third sheets fixed to said formed section, said first sheet being thereby capable of movement relative to said formed section fixed to said second and third sheets.

3. The method in accordance with claim 2 including initially locating said first, second and third sheets in one plane, said first, second and third sheets being joined to one another by two strips, folding said sheets respectively along said strips in a manner to superpose said three sheets one on top of the other.

4. The method in accordance with claim 2, including providing an outer strip on said first sheet for attaching said device to a publication.

5. A relatively movable device comprising: a first sheet and a second sheet; said first sheet being superposed with respect to said second sheet; said first sheet having at least one perforation therein contiguous at least one frangible discontinuity; said perforation in combination with said frangible discontinuity defining a discontinuous section; means adhering to one side of said discontinuous section within one side of said second sheet; said frangible discontinuity including means being constructed and arranged to shear upon manipulation of said first sheet relative to said second sheet, thereby forming a continuous section from said discontinuous section; said continuous section and said first sheet including means being constructed and arranged so that said continuous section permits relative movement of said first sheet with respect to said second sheet and with respect to said continuous section affixed to said second sheet upon said frangible discontinuity being sheared.

6. A device according to claim 5 including a third sheet, means adhering respective sides of said discontinuous section to facing sides of said second and third sheets respectively, said discontinuous section including means being constructed and arranged to shear upon the manipulation of said first sheet relative to said second and third sheets, thereby forming a continuous section, said first sheet thereby being capable of movement relative to said continuous section fixed to said second and third sheets.

7. A device according to claim 6, said first sheet carrying inscriptions thereon, said second sheet having at least one opening therein constructed and arranged so that said inscriptions are visible through said opening in said second sheet.

* * * * *